US005413278A

United States Patent [19]

Erikson

[11] Patent Number: 5,413,278

[45] Date of Patent: May 9, 1995

[54] REMOTELY ACTIVATED OPPOSING PRESSURE AIR FLOW CONTROL REGISTER

[76] Inventor: Evans W. Erikson, 6526 Spring Brook Rd., Rockford, Ill. 61114

[21] Appl. No.: 269,103

[22] Filed: Jun. 30, 1994

[51] Int. Cl.[6] ..... F24F 7/00

[52] U.S. Cl. ..... 236/49.3; 137/802; 236/51; 415/910; 417/326; 454/297

[58] Field of Search ..... 236/49.3, 51; 415/910; 137/802; 417/315, 326; 454/292, 297

[56] References Cited

U.S. PATENT DOCUMENTS

| | | | |
|---|---|---|---|
| 3,320,406 | 5/1967 | Wainwright | 417/326 X |
| 3,776,279 | 12/1973 | O'Connor, Jr. | 137/802 |
| 4,479,604 | 10/1984 | Didner | 236/49 |
| 4,530,395 | 7/1985 | Parker et al. | 165/16 |
| 4,969,508 | 11/1990 | Tate et al. | 165/22 |
| 5,271,558 | 12/1993 | Hampton | 236/49.3 |

*Primary Examiner*—William E. Tapolcai
*Attorney, Agent, or Firm*—Harold A. Williamson

[57] ABSTRACT

The invention is directed to a method and apparatus for controlling airflow in a given direction in an air circulating system in which the method comprises the steps of:

(a) placing a motor driven fan in the air circulating system in such a manner that the fan, when driven by the motor, creates pressure in a direction opposing the given direction of airflow, and (b) activating the motor to drive the fan to cause the airflow moving in said given direction to be diminished because of said opposing pressure.

The apparatus is directed to an air flow controllable register for controlling a flow of air through the register from a register air flow supply duct in response to an externally provided control signal that commands differing airflow rates through the register. More specifically, the air flow controllable register includes a register flow control unit that includes a rotary mounted fan positioned within the register airflow supply duct. The fan is coupled to a motor. The fan when driven by the energized motor creates air pressure from the fan to reduce the flow of air from the supply duct.

11 Claims, 4 Drawing Sheets

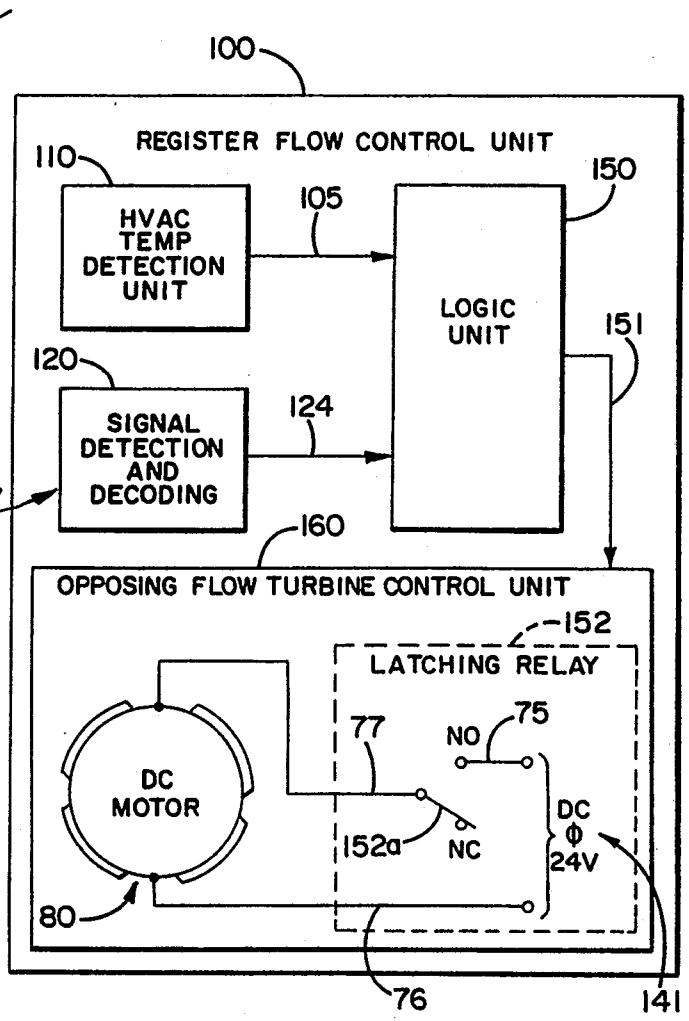
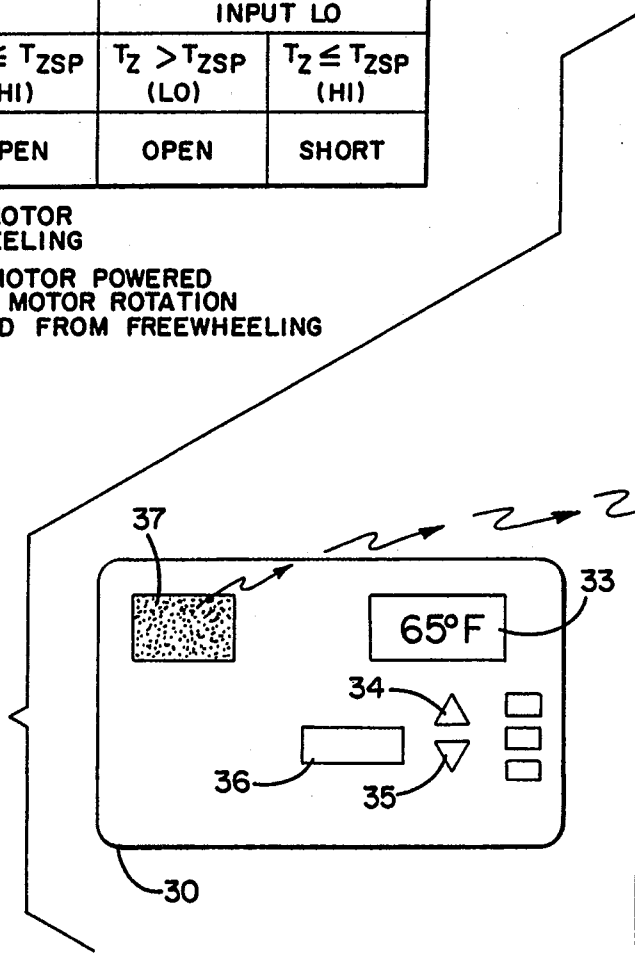
FIG. 4
| LOGIC UNIT | | | |
|---|---|---|---|
| INPUT A | HEATING MODE INPUT HI | COOLING MODE INPUT LO | |
| INPUT B | $T_Z > T_{ZSP}$ (LO) | $T_Z \leq T_{ZSP}$ (HI) | $T_Z > T_{ZSP}$ (LO) | $T_Z \leq T_{ZSP}$ (HI) |
| | SHORT | OPEN | OPEN | SHORT |
OPEN = DC FAN MOTOR FREEWHEELING
SHORT = DC FAN MOTOR POWERED AND FAN MOTOR ROTATION REVERSED FROM FREEWHEELING
FIG. 5

REMOTELY ACTIVATED OPPOSING PRESSURE AIR FLOW CONTROL REGISTER

FIELD OF THE INVENTION

A Control system and air flow control register for use in a single or multi zone HVAC unit where air is delivered into one or more zones through an air delivery register (s).

BACKGROUND OF THE INVENTION

It has been long recognized in large building structures that the cost of heating or cooling the structure significantly impacts the bottom line of the large business enterprise that occupy these structures. It is also know that for a small business entities such as a clinic, office or retail structure total energy costs related to lighting, heating or cooling breaks down this way: 40% is for heating and cooling, 40% for lighting and the balance for business related equipment. The U.S. Department of Energy estimates that a substantial portion of the heating, cooling and lighting cost is wasted as a result of the lack of an economical, effective system to control it.

In the design stage of large business structures elaborate lighting heating and cooling systems are built into the structures at the outset with an expectation that significant energy savings translated into dollars will be realized for the businesses occupying these structures. In the smaller business building market almost all heating and ventilation systems employ a single zone HVAC unit to supply conditioned, heated or cool air to more than one distinct zone or room. Each room or zone may have different comfort requirements due to occupancy differences, individual preferences, exterior load differences or the different zones may be on different levels, thereby creating different heating or cooling requirements. This type of system is referred to a single zone HVAC unit because it is normally controlled from one centrally located ON/OFF thermostat controller. In a building which may have more than one zone and whose zones have different heating, cooling requirements, it becomes difficult to choose a good representative location for the thermostat controller.

In the technical literature which embrace patented technologies there have been a number of note worthy attempts to provide systems that address the problems of controlling the different needs of more than one zone which is provided heating and cooling from a single zone HVAC.

Among the most recent U.S. Patents is that of Brian Hampton U.S. Pat. No. 5,271,558 ('558) titled Remotely Controlled Electrically Activated Air flow control register. The '558 patent is assigned to the same assignee as that of the instant application. Many of the circuit details setforth in the subject application were originally setforth and fully described in the '558 patent. No claims of novelty is put forward with respect to these circuit details per se in this application.

The invention of the '558 Patent is directed to a control system for an air delivery system having a supply duct through which air is delivered into at least one independently controlled zone though an air delivery register. A wireless airflow control unit is provided to transmit a wireless airflow control signal output to an electrically powered and electrically self-sufficient flow control unit located in at the air delivery system. The electrically powered and electrically self-sufficient flow control unit controls the flow of the air in response to receiving the wireless air flow control signal output. The electrically powered and electrically self sufficient flow control unit includes a generator to provide electrical power in response to flow of air from the supply duct. The generated electric power is delivered to the flow control unit to thereby maintain the flow control unit electrically self-sufficient and free from the need of any outside electrical power source. The generator includes a rotary mounted turbine positioned within a supply duct of the air delivery register. The Turbine is coupled to the generator to drive the generator in response to conditioned air flow against blades of the turbine. The generator provides electric power to the flow control unit to maintain the flow control unit electrically self sufficient. The air delivery system is a normally single zone HVAC unit. The flow control unit includes a HVAC temperature detection unit that determines when the HVAC unit is delivering heated, cooled conditioned air or recirculating ambient air. The HVAC temperature detection unit has an output signal to a logic unit. The logic unit is also responsive to a wireless airflow control signal. The flow control unit additionally includes a turbine/generator load control unit coupled electrically to receive an output signal from the logic unit. The logic unit output signal controls a loading of the generator so that the air turbine is braked thereby reducing flow of conditioned air past the air turbine and into a Zone.

The invention of the '558 patent has proved to be popular especially where there is present a high level of concern for maximizing electrical energy savings. The subject invention, however, has proved equally popular in environments where low voltage D.C. power may be employed to power the electronics mounted in the register and to power a D.C. or A.C. motor to drive a turbine as a fan in such a manner as to provide air pressure that opposes the normal air flow in the air delivery system, thereby controlling conditioned air flow through the register in a zone.

Another such U.S. patent is that of Tate et al U.S. Pat. No. 4,969,508 (508) in which the temperatures in the room(s) are controlled by means of a wireless portable remote control unit which may be hand held by the room occupant. The wireless remote control unit transmits information to a remote receiver in the ceiling of the room, which in turn provided signals to a main control unit physically coupled to external environmental control units such as the air conditioning system, heater, damper motors and the like.

The wireless remote control unit of the '508 patent in addition to being able to select heating and cooling modes may also operate in an energy saving mode. To this end a light sensing circuit is provided for overriding preselected conditions when the lights in the room are off. An infra red transmitter is employed for transmitting data to an infra red receiving unit on the ceiling when the lights are on.

The subject invention distinguishes over the '508 patent in that the '508 patent requires wiring of an entire duct work system to provide power to many power driven dampers, whereas the subject invention simply calls for an A.C. or D.C. power converter in each room or zone to be controlled. The subject invention additionally provides a low D.C. voltage source at the register to power the electronics associated with the control of the register.

Another approach to providing multiple heating-/cooling zones which employ a single zone HVAC unit is shown and described in the Parker et al U.S. Pat. No. 4,530,395 ('395) U.S. patent. The Parker et al arrangement provides zone control in plural zones in which each zone includes a control thermostat that is interfaced with a monitoring system so that each zone thermostat controls the HVAC unit as well as a damper unit for that particular zone. More specifically the system is comprised of two or more computerized thermostats which control both the HVAC unit through the monitoring control and the air distribution system of each zone through the damper for each zone. The thermostats also operate under control of signals received from the monitor.

The '395 is classic in its complex solution to the very simple concern of independently and automatically controlling the temperature in one of many zones simultaneously. The '395 patent like the '508 just reviewed requires electrically powered damper motors that become part of a complex wiring system.

The subject invention requires no such complex wiring and may be readily installed in existing HVAC system by simply removing a selected air distribution register and placing within an exposed air supply duct the apparatus of the instant invention, which is then electrically connected to an existing electrical system by means of an A.C. to D.C. converter.

A wireless thermostat control device hung on a wall of a zone wall completes the installation of the subject invention in almost no time at all with little labor cost.

In yet another multiple zone system having a single central HVAC unit Robert S. Didier in his U.S. Pat. No. 4,479,604 ('604) shows and describes a controller for a central plant feeding a plurality of adjustable zone regulators which bring their respective zones to corresponding target temperatures. The controller has a plurality of temperature sensors and a plurality of zone actuators. The temperature sensors distributed one to a zone, each produce a zone signal signifying zone temperature. The zone actuators each have a zone control terminal. Each actuator can, in response to a signal at its zone control terminal, operate to adjust a corresponding one of the zone regulators. The controller also has a control means coupled to each of the temperature sensors and to the zone control terminal of each zone actuator for starting the central plant. The central plant is started in response to a predetermined function of zone temperature errors (with respect to their respective target temperatures) exceeding a given limit. The systems considers the temperature error in each of the zones. When the sum of the errors exceeds a given number, the furnace or air conditioner can be started.

In addition to the distinctions offered in respect of the '508 and '395 patents the subject invention is amazingly simple in design and may be powered by a D.C. voltage power source at a zone to be controlled thereby obviating the need for a complex wiring system inherent in the '604 patent.

SUMMARY OF THE INVENTION

The invention is directed to a method and apparatus for controlling airflow in a given direction in an air circulating system in which the method comprises the steps of:

(a) placing a motor driven fan in the air circulating system in such a manner that the fan, when driven by the motor, creates pressure in a direction opposing the given direction of airflow, and (b) activating the motor to drive the fan to cause the airflow moving in said given direction to be diminished because of said opposing pressure.

More specifically, the invention is directed to an air flow controllable register for controlling a flow of air through the register from a register air flow supply duct in response to an externally provided control signal that commands differing airflow rates through the register. More specifically, the air flow controllable register includes a register flow control unit that includes a rotary mounted fan positioned within the register airflow supply duct. The fan is coupled to a motor. The fan when driven by the energized motor creates air pressure from the fan to reduce the flow of air from the supply duct.

The register flow control unit is responsive to the externally provided control signal to provide for the energizing of the motor coupled to the fan to provide air pressure against the flow of air from the supply duct thereby simultaneously diminishing air flow past the fan and through the register.

It is therefore a primary object of the invention to provide a method and apparatus for controlling airflow in a given direction in an air circulating system.

It is also a major object of the invention to provide an electrically controlled automatically adjustable air flow register.

Another object of the invention is to provide an air circulating system that controls air flow in a given direction in the system by introducing an opposing pressure to thereby diminish air flow past a point in the system where the opposing pressure has been introduced.

A further object of the invention is to provide an automatically adjustable airflow register that when added to an existing system has minimal affect on air flow when a free flow of air through the register is desired.

Yet another object of the invention is to provide a method of controlling air flow in a system by employing a motor driven fan positioned in the system in such a manner that when the motor is activated or energized the fan rotates in a direction such that a pressure is provided which opposes normal airflow in the system thereby controlling system airflow.

In the attainment of the foregoing objects the invention contemplates as falling with the purview of the claims a control system for an air delivery system which is normally a single zone HVAC unit. The air delivery system includes a single air supply duct through which conditioned air is delivered. The control system assumes that there is at least one independently controlled zone or room which received air delivered through an air delivery register.

The control system includes two basic components one of which is an air flow thermostat control that communicates with and controls an electrically powered register flow control unit which controls the flow of conditioned air through the air delivery register.

A typical system involves a plurality of zones each zone having one or more air delivery registers, each of which is coupled to the single air supply duct noted earlier.

The air flow control thermostat delivers an airflow control signal which is characterized as a continuously transmitted control signal for as long as a desired setpoint temperature for an associated zone is either above or below an ambient temperature in the associated zone.

The electrically powered register flow control unit controls the flow of air through the register in response to receiving the flow control signal. This just noted register flow control unit includes a motor driven fan within a register supply duct associated with an air delivery register. The motor driven fan is positioned in such a manner that, when energized, the fan rotates so as to provide an opposing air pressure to that which normally passes through the register. This opposing pressure diminishes the amount of air flow passing the fan thereby controlling the air flow through the register into a zone.

In systems where both heating and cooling unit are provided the register flow control unit also includes an HVAC temperature detector to determine whether the HVAC unit is delivering heated or cooled air. The HVAC temperature detector has an output signal to a logic circuit representative of either heating or cooling by the HVAC.

In a preferred embodiment of the invention the register flow control unit includes an airflow control signal detection circuit electrically coupled to a decoding circuit to provide an output signal from the decoding circuit to the logic circuit representative of whether an ambient temperature in a zone associated with the register flow control unit is greater than a desired setpoint temperature of the zone or whether the decoding circuit output is representative of the fact that the ambient temperature in the zone is less than or equal to the desired setpoint temperature in the zone.

Finally the logic circuit provides the output signal which controls the energization of the motor driven fan whenever a preselected combination of output signals from the HVAC temperature detection circuit and decoding circuit call for decrease air flow through the air delivery register.

In less technical terms and by way of summary, assume that it is summer, during the cooling season and the air conditioning has just come on in an office building. In the cooling operation, cooled air flows down the air supply duct through the flow control unit and out an air delivery register. As the cool air flows down the air supply duct through the register flow control unit the flow of air turns the fan in a free wheeling manner such that little restriction to air flow through the register is present. This operation will continue until the flow control thermostat has determined that the desired temperature level has been reached. Now that the room or zone is cool enough and further amounts of air are not only unnecessary, but waste costly energy, the system responds by having the flow control thermostat signal electronic controls in the register flow control unit to restrict further air flow by energizing the motor driven fan to provide an opposing air pressure to normal system flow at the register.

From the foregoing it will be readily appreciated that the opposing airpressure will result in a significantly reduced air flow from the register flow control unit through the air delivery register.

The increase in back pressure at a single register in a multiple register system will cause an increase in flow from other registers in the system. This accelerates the cooling in the other offices or zones. As each of them reaches a comfort set point selected by an office user, the register air flow control unit will reduce air flow to that office.

The result of restricting air flow to each office or room in this manner provides not only a substantial increase in comfort, but the achievement of comfort levels more quickly than the standard on/off method so that the air conditioning unit can be shut down sooner saving energy cost.

Use of the invention also reduces the flow from the supply system which reduces the energy required to drive the supply system.

BRIEF DESCRIPTION OF THE DRAWINGS

The description setforth above, as well as other objects, features and advantages of the present invention, will be more fully appreciated by referring to the detailed description and the drawings that follow. The description is of the presently preferred but, nonetheless, illustrative embodiment in accordance with the present invention, when taken in conjunction with the accompanying drawing wherein;

FIG. 4 is a block diagram illustration of an air control system, that embodies the invention;

FIG. 5 is a logic unit block diagram:

DETAILED DESCRIPTION OF THE PREFERRED EMBODIMENTS

Figure 1:
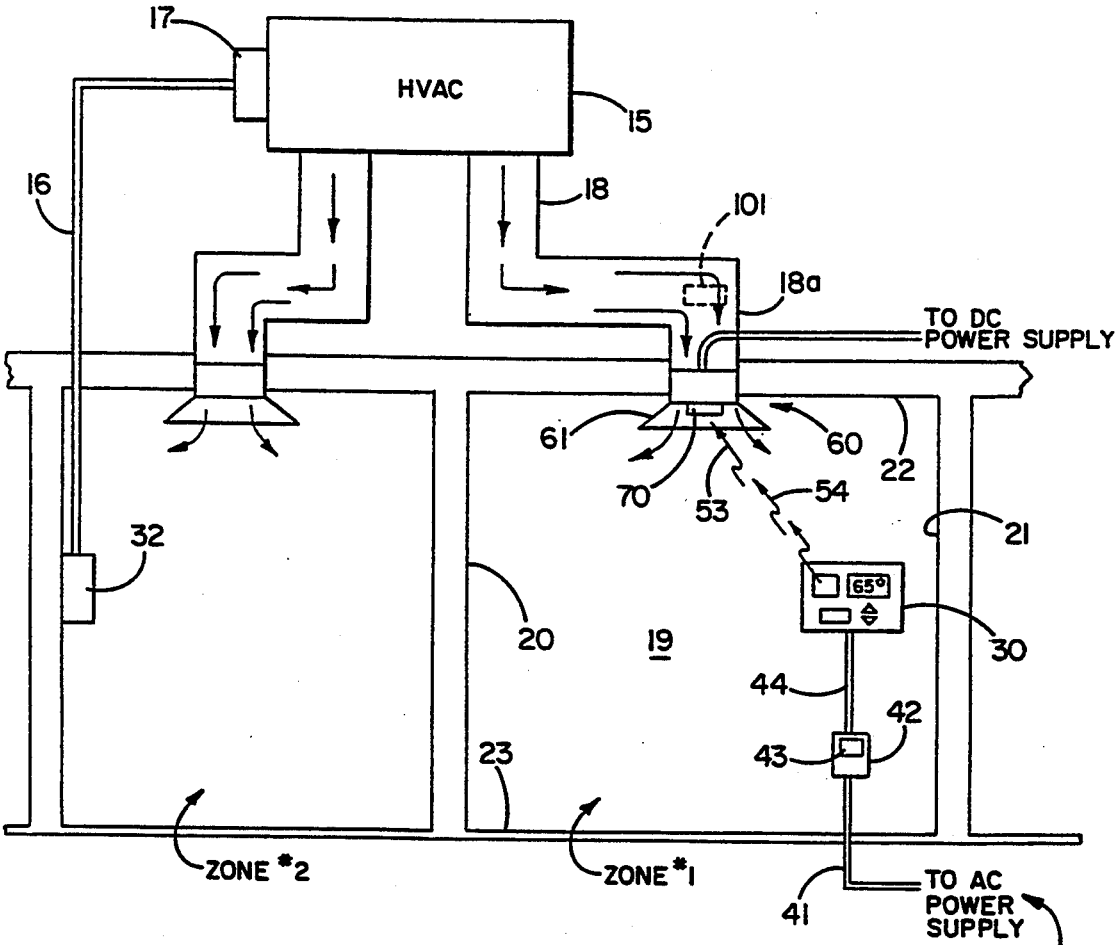
FIG. 1 is a schematic layout of an office complex with a number of zones to be heated or cooled by employing the invention described herein.

Reference is now made to FIG. 1 which illustrates schematically an office complex in a building not shown. The office complex includes two (2) zones to be provided with forced hot or cooled air from a HVAC (heating, ventilating, air conditioning) unit 15. Zone #1 is defined by a pair of side walls, 20 and 21, a ceiling 22 and floor 23. A fourth side wall is present, but not shown. Accordingly zone #1 is one of many office/-rooms in the office complex. Zone #2 is similar in overall configuration as zone #1.

The zone #1 includes a wall mounted wireless air flow control thermostat (30, 31) to be described more fully hereinafter with respect to FIG. 6. It is to be understood that while the preferred embodiment of the invention shows the use of a wireless infra red (IR) controlled thermostat. The invention is equally useful with a wide range of different types of thermostats of a wireless or hard wired nature. Zone 2 is provided with a conventional ON/OFF thermostat 32 electrically coupled via an electrical line 16 to HVAC controller 17. Electrical power is provided to the wireless air flow control thermostat 30 from an AC power supply 40 via electrical line 41. Line 41 leads to a wall outlet 42 which has schematically shown a zone manager power supply 43 to provide electrical power via line 44 to wireless air flow control thermostat 30. Wireless airflow control signals 53, 54 depicted as jagged separated lines are shown directed toward an air diffuser portion 61 of air delivery register 60. The HVAC 15 delivers conditioned air to zone #1 via a single air supply duct 18 and a branch air supply duct 18*a*. Positioned in the branch air supply duct 18*a*, as shown in FIG. 2 and FIG. 3, are the electrically powered register flow control unit 70 of the instant invention.

Figure 2:
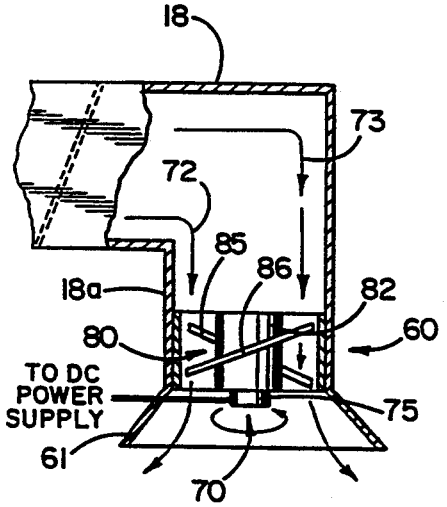
FIG. 2 shows in cross section a portion of the air flow control system that embodies the invention where the invention is depicted in a free-wheeling mode.
Figure 3:
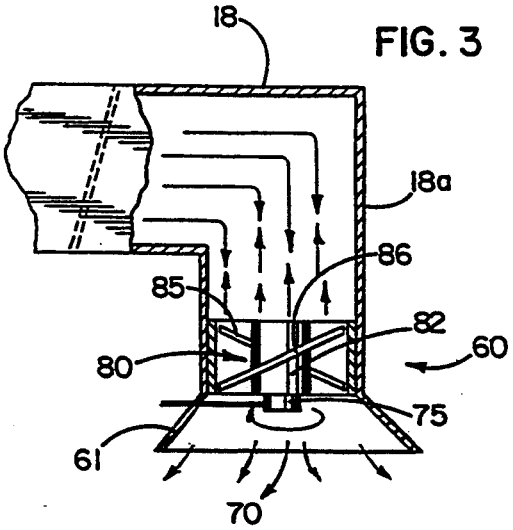
FIG. 3 shows in cross section a portion of the air flow control system that embodies the invention where the invention is depicted in an air flow opposing mode.

In order to appreciate how the register flow control unit 70 operates, one of the units 70 is shown in FIG. 2 in partial section in a free wheeling mode and in partial section in FIG. 3 in an airpressure opposing mode.

Turning now to FIG. 2 there is shown an end portion of the single air supply duct 18 with a branch air supply duct 18*a* secured thereto by means not shown. An air diffuser portion 61 which forms a major part of the air diffuser register 60 is secured to the branch air supply duct 18*a* by conventional means not shown. An electrically powered register flow control unit 70 is shown in position to demonstrate the manner in which air flow, indicated by air flow arrows 72 and 73, pass by the register flow control unit when a fan 80 is in a free-wheeling mode.

In FIG. 3 an arrow 70 points towards the electrically powered register flow control unit. The register flow control unit is made up of two major elements, the first of which is an electronic control box 75 that is electrically coupled via leads not shown to an input of a D.C. motor not shown but mounted within a rotatable supported air turbine hub 82. The hub 82 also forms the rotor of the DC motor. The motor could also be an AC motor. The operation of the electronic circuitry in the electronic control box 75 which is secured to a structural member not shown of the air delivery register 60 will be described when the operation of FIG. 4 is reviewed.

When FIG. 3, 4 and 5 are studied together the operation and air passage reduction function of the fan 80 and motor contained in air turbine hub 82 will become apparent. In FIG. 3 there is shown fitted in branch air supply duct 18*a* the fan 80 and its hub 82 which contains a motor and which may be secured to the duct 18*a* by conventional means not shown. Secured to the turbine hub 82 are fan impeller blades. Only two (2) fan blades 85, and 86 are shown. It is to be understood the number of fan blades is a matter of design and may number more than two.

Figure 7:
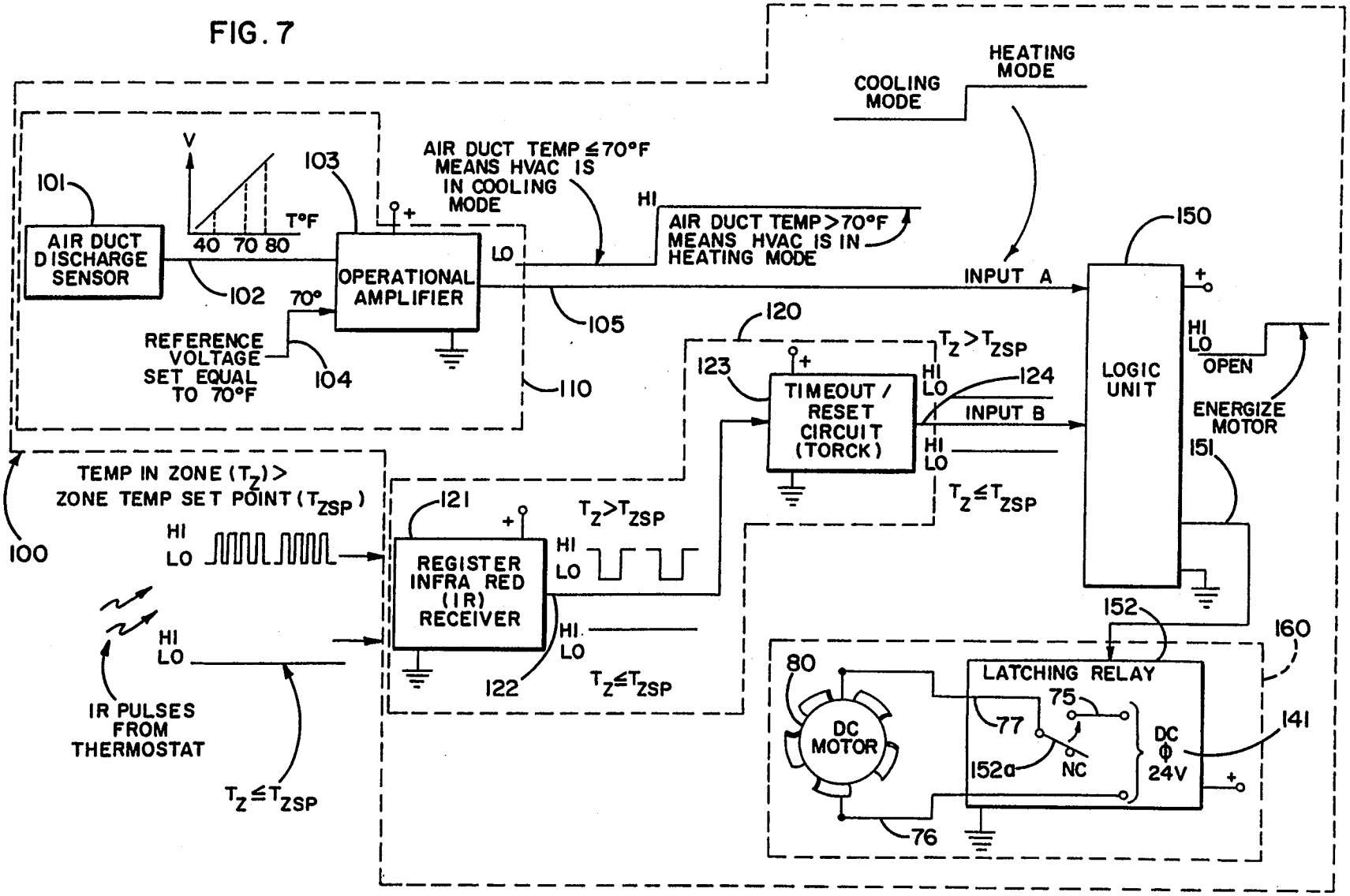
FIG. 7 is a schematic showing of the relationship of the components present in a register flow control unit embodying the invention.

Reference is now made to FIG. 4 which depicts in schematic form the basic components of a control system for an air delivery system embodying the invention. On the left, as FIG. 4 is viewed, is wireless air flow control thermostat 30, which includes conventional set temperature readout 33; manually operable temperature increase and decrease select buttons 34, 35; heating or cooling select button 36, and infra red (IR) transmitter 37. The register flow control unit 100 which is electrically powered and is electrically self-sufficient is shown schematically in FIG. 4 on the right side of the drawing. A detailed layout of the register flow control unit 100 is shown in FIG. 7 and will be described in detail hereinafter. It is sufficient to note at this point that the register flow control unit 100 includes, interconnected as shown, four (4) basic functional components, namely an HVAC temperature detection circuit or unit 110; a wireless air flow control signal detection and decoding unit or circuit 120; a logic unit 150, and an opposing flow turbine control unit 160.

Figure 6:
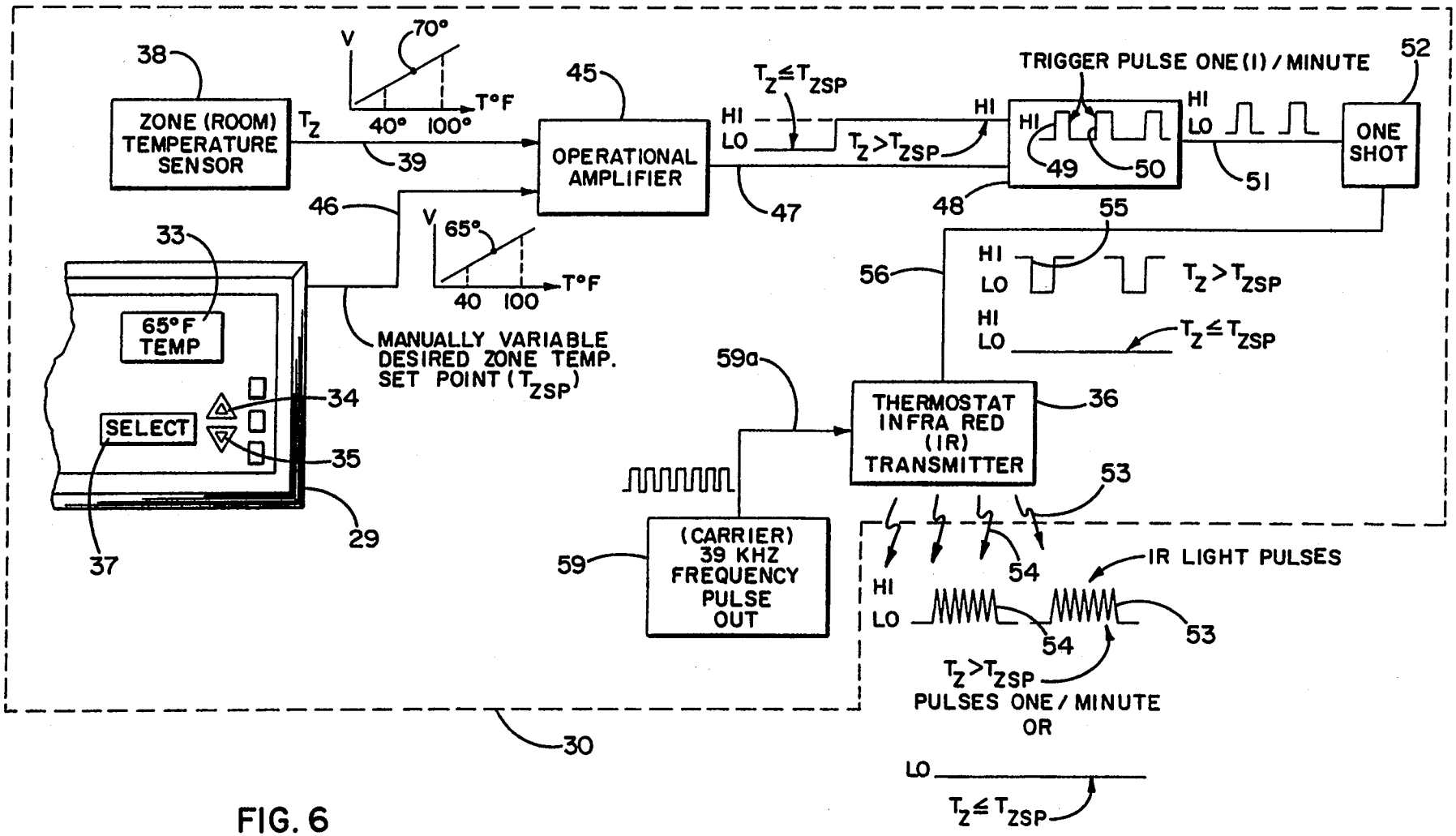
FIG. 6 is a schematic showing of the relationship of the components present in a wireless flow control thermostat employed in the invention.

Attention is now directed to FIG. 6 which illustrates in block diagram layout the details of the wireless air flow control thermostat 30 employed in zone #1 of FIG. 1.

In the left hand portion of the drawing of FIG. 6 there is shown in broken away fashion an external portion 29 of the wireless air flow control thermostat 30 described with respect to FIG. 6. Shown in broken line 29 surrounding the block diagram are the essential component parts of the wireless air flow control thermostat 30 which will now be described. The wireless thermostat 30 includes in a conventional manner a zone or room temperature sensor 38 which provides on an output lead 39 a signal representative of the rooms ambient temperature, Tz, at any given moment. The ambient temperature signal on lead 39 is delivered to an operational amplifier 45 which has as another input lead 46 which provides a manually variable, desired zone temperature setpoint (Tzsp). In the situation being described the Tzsp has been selected by the zone #1 occupant at 65 F. The operational amplifier 45 functions in a conventional manner and provides an output lead 47 a low (Lo) output whenever the ambient zone temperature TZ is less than or equal to the zone temperature setpoint TXsp, (Tz<Txsp) here 65 F. and a Hi output whenever the ambient zone temperature Tz is greater than the zone temperature setpoint Tzsp (65 F.), namely Tz>Txsp. The lead 47 is connected as shown to a trigger pulse circuit 48 which responds to produce trigger pulses 49, 50 at the rate of one per minute whenever the output signal on lead 47 from the operational amplifier 45 goes Hi. The trigger pulses 49, 50 appears on lead 51 where they are delivered to a one shot circuit 52 that produces the wave form output 55 on lead 56 whenever and for as long as TZ>Tzsp. The wave form output 55 appears on lead 56 where it triggers the thermostat infrared (IR) transmitter 36 to provide the wireless IR signals 53, 54 to the register flow control unit 100 not shown in this figure. A carrier frequency source 59 of 39 KHZ modulates the IR signal output over lead 59*a* to provide the wave from 53, 54 shown below as jagged line IR signals 53, 54. It should be apparent that when the temperature in the zone Tz is less than or equal to the zone temperature setpoint Txsp ie 65 F. there will be no IR transmitter 36 output.

Attention is now directed to FIG. 7 which illustrates in a schematic block diagram form the internal workings of the register flow control unit 100 shown in broken line. At the left hand side of the drawings of FIG. 7 there is shown in broken line an HVAC temperature detection unit or circuit 110. This HVAC temperature detection circuit 110 includes two major components, namely, an air duct discharge sensor 101 and to an operational amplifier 103 via a lead 102. The sensor 101 and operational amplifier 103 are conventional in nature. The air duct discharge sensor 101 is positioned in the system so that conditioned discharge air flowing form the main supply duct 18 via duct branch the heating or air cooling mode. The temperature of 70 F. has been selected as a reference point. Whenever the air coming from HVAC unit 15 through ducts 18 and 18*a* is above 70 F., this condition will be considered to be a heating mode, whereas if the temperature of the air from the HVAC is below 70 F. the system will be considered to be its cooling mode. Accordingly, the operational amplifier 103 is designed to provide a Lo output on Lead 105 indicating the HVAC as operating in a heating mode. The Hi or Lo outputs on lead 105 are delivered to logic unit 105, the function of which will be described hereafter.

Just beneath the HVAC temperature detection unit 110, also shown setout in broken line, is the wireless air flow control signal detection and decoding unit or circuit 120. The basic functions of this just noted unit 120 are to receive ie detect the wireless IR signals 53, 54 from the wireless air flow control thermostat 30 and decode the transmitted information from the wireless air flow control thermostat transmitter 36.

The wireless IR signals 53, 54 are received by infrared (IR) receiver 121 which in turn provides a signal out on lead 122 representative of an envelope 123 of the signals 53, 54. The possible output signals on lead 122 are shown for the conditions Tz>Tzsp which represents zone ambient temperature greater than zone temperature setpoint which had been arbitrarily set at 65 F. for purposes of explaining the air flow control system operation.

The just described output on lead 122 is delivered to timeout/reset circuit (TORCKT) 123 which provides an output on lead 124 to the logic unit 150. The TORCKT 123 is designed to provide a low (Lo) output on lead 124 when the IR pulses are representative of the condition Tz<Tzsp and a Hi output on lead 124 when the IR pulses are not present on the lead 122 to the TORCKT 123 for 5 minutes. When this state is present the output on lead 124 goes Hi indicating that TZ<Tzsp.

Located on the lower right hand corner of the drawing of FIG. 7 is the opposing flow fan control unit 160 shown in broken line. Direct current is provided on leads 75, 76 from a power supply not shown. The power supply may use conventional AC to DC converter that provides 24 volt DC over leads 75, 76 via the front relay contact **152*a* of a latching relay 152 to DC motor driven turbine 80**.

The logic unit 150 has a single output on lead 151 which is electrically connected to a latching relay 152 which when energized goes from a normally closed (NC) electrical contact position to a normally open (NO) electrical contact position. When the latching relay 152 is activated an electrical circuit is completed across the DC motor driven turbine 8 and DC power supply 141 via leads 75, relay contact **152*a*, lead 77 and lead 76. This results in the energizing of the DC motor driven turbine 80 which results in the DC motor driven turbine providing a flow of air that opposes the normal flow of air through the register. This results in a significantly reduced air flow through the register air flow control unit 100 and the air delivery register 60** in particular.

It should be understood that the invention contemplates as included with in the language of the claims solid state electronic devices in place of for example the latching relay 152.

An understanding of the full operation of air control system is readily discernable when the "Logic Unit" of FIG. 5 is studied in conjunction with the earlier described units and circuits.

In accordance with the primary object of the invention to provide a method and apparatus for controlling airflow in a given direction in an air circulating system, it follows that while in the preferred embodiment of the invention the powered flow control unit is shown in a register, the powered flow control unit maybe positioned anywhere in the system to provide an airflow damping function in accordance with the invention.

Though the invention has been described with respect to as specific preferred embodiment thereof, many variations and modifications will immediately become apparent to those skilled in the art. It is therefore the intention that the appended claims be interpreted as broadly as possible in view of the prior art to include all such variations and modifications.

What I claim is new:

1. An airflow controllable register system for controlling flow of air through the register from a register air flow supply duct in response to an externally provided control signal that commands differing air flow rates through said register, said air flow controllable register comprising:

a register flow control means that includes a rotary mounted fan positioned within said register air flow supply duct, said fan coupled to a motor to be energized, said fan when driven by said energized motor creates air pressure from the fan to reduce the flow of air from the supply duct, said register flow control means responsive to said externally provided control signal to provide for said energizing of said motor coupled to said fan to provide said air pressure against said flow of air from the supply duct thereby simultaneously diminishing air flow past said fan and controlling air flow through said register.

2. The airflow controllable register system of claim 1 including in combination therewith a single zone HVAC unit.

3. The flow control system of claim 2 wherein said supply duct is a single air supply duct through which conditioned air is delivered.

4. The flow control system of claim 3 wherein there is included an air flow control means that provides a temperature control signal to control said register flow control means.

5. The flow control system of claim 4 wherein said temperature control signal is delivered as long as a desired setpoint temperature for a zone is either above or below an ambient temperature in said associated zone.

6. The flow control system of claim 5 wherein said register flow control means further includes an HVAC temperature detection means to determine when said HVAC unit is delivering heated or cooled condition air, said HVAC temperature detection means having an output signal to a logic means representative of either heating or cooling by said HVAC, said temperature detection means including an air duct discharge temperature sensor.

7. The flow control system of claim 6 wherein said register flow control means includes an airflow control signal detection means electrically coupled to a decoding means to provide an output signal to said logic means representative of whether an ambient temperature in a zone associated with said register flow control means is greater than a desired setpoint temperature of said zone or whether said decoding circuit output signal is representative of said ambient temperature in said zone being less than or equal than said desired setpoint temperature of said zone.

8. The flow control system of claim 7 wherein said register flow control means includes an opposing air pressure fan control means coupled electrically to receive an output signal from said logic means, said logic means output signal controlling the energization of said motor so that said fan is driven by said motor in a direction to provide said opposing pressure.

9. The flow control system of claim 8 wherein said logic means provides said output signal which controls the energization of said motor when a preselected combination of output signals from said HVAC temperature detection means and said decoding means call for a decrease air flow through said air delivery register.

10. The flow control system of claim 9 wherein said fan has fan blades integrally secured to a rotatably mounted hub, said hub acting as a rotor for said motor.

11. A method for controlling air flow in a given direction in an air circulating system comprising the steps of:

a) placing a motor driven fan in said air circulating system in such a manner that said fan when driven by the motor creates pressure in a direction opposing said given direction of air flow, and b) activating said motor to drive said fan to cause said air flow moving in said given direction to be diminished because of said opposing pressure.

* * * * *